US008757317B1

(12) United States Patent
Wang

(10) Patent No.: US 8,757,317 B1
(45) Date of Patent: Jun. 24, 2014

(54) BARREL-SHAPED MULTIDIRECTIONAL LOUDSPEAKER ENCLOSURE STRUCTURE

(71) Applicant: Longinesteno Technology Complex Corporation, New Taipei (TW)

(72) Inventor: Chao-Lang Wang, New Taipei (TW)

(73) Assignee: Longinesteno Technology Complex Corporation, New Taipei (TW)

( * ) Notice: Subject to any disclaimer, the term of this patent is extended or adjusted under 35 U.S.C. 154(b) by 0 days.

(21) Appl. No.: 13/886,499

(22) Filed: May 3, 2013

(51) Int. Cl.
*H04R 1/02* (2006.01)

(52) U.S. Cl.
USPC ..... 181/153; 381/336

(58) Field of Classification Search
USPC ..... 181/153, 155, 199; 381/336, 338, 352
See application file for complete search history.

(56) References Cited

U.S. PATENT DOCUMENTS

| | | | | | |
|---|---|---|---|---|---|
| 3,090,461 | A * | 5/1963 | Gray | 381/346 |
| 3,486,578 | A * | 12/1969 | Albarino | 381/350 |
| 3,638,753 | A * | 2/1972 | Cunningham | 181/153 |
| 3,818,138 | A * | 6/1974 | Sperrazza, Jr. | 381/336 |
| 4,474,258 | A * | 10/1984 | Westlund | 181/151 |
| 5,444,194 | A * | 8/1995 | Reinke | 181/150 |
| 5,525,767 | A * | 6/1996 | Fields | 181/155 |
| 5,710,395 | A * | 1/1998 | Wilke | 181/153 |
| 5,832,099 | A * | 11/1998 | Wiener | 381/386 |
| 5,866,858 | A * | 2/1999 | Dewey | 181/151 |
| 5,995,634 | A * | 11/1999 | Zwolski | 381/160 |
| 6,628,797 | B2 * | 9/2003 | Yamada | 381/345 |
| 6,634,455 | B1 * | 10/2003 | Yang | 181/156 |
| D484,871 | S * | 1/2004 | Solland | D14/216 |
| D497,358 | S * | 10/2004 | Takeuchi et al. | D14/211 |
| 6,973,994 | B2 * | 12/2005 | Mackin et al. | 181/156 |
| 7,006,648 | B2 * | 2/2006 | Wang | 381/336 |
| 8,284,972 | B2 * | 10/2012 | Lin | 381/322 |
| 8,406,444 | B2 * | 3/2013 | Wang | 381/335 |
| 8,428,290 | B2 * | 4/2013 | Cheng | 381/386 |
| 2006/0153413 | A1 * | 7/2006 | Nakajima et al. | 381/345 |
| 2008/0279406 | A1 * | 11/2008 | D'Hoogh | 381/332 |
| 2009/0173567 | A1 * | 7/2009 | Stiles | 181/148 |
| 2010/0183180 | A1 * | 7/2010 | Tsai | 381/338 |
| 2013/0028458 | A1 * | 1/2013 | Suzuki et al. | 381/338 |

* cited by examiner

*Primary Examiner* — Jeremy Luks
(74) *Attorney, Agent, or Firm* — Bacon & Thomas, PLLC

(57) ABSTRACT

The present invention is to provide a loudspeaker enclosure structure which includes a hollow housing being a barrel-shaped housing whose outer surface is concavely provided with a plurality of directional grooves each evenly arranged along the circumferential direction of the hollow housing and extending from the front end to rear end of the hollow housing, and a reflective cover having a front side fixed to a rear opening of the hollow housing and concavely provided with an annular reflective groove adjacent to the periphery of the reflective cover. The hollow housing has a receiving space therein which is in communication with each directional groove through the reflective groove. Therefore, the sound generated by a loudspeaker fixed in the receiving space will not only propagate out of the front end of the hollow housing, but also be transmitted to the space surrounding the hollow housing by way of the directional grooves.

14 Claims, 10 Drawing Sheets

BARREL-SHAPED MULTIDIRECTIONAL LOUDSPEAKER ENCLOSURE STRUCTURE

FIELD OF THE INVENTION

The present invention relates to a loudspeaker enclosure structure, more particularly to a barrel-shaped multidirectional loudspeaker enclosure structure including a barrel-shaped hollow housing, a loudspeaker fixed in the hollow housing, and a reflective cover having a front side fixed to a rear opening of the hollow housing, so as to enable the sound generated by the loudspeaker can not only propagate out of a front opening of the hollow housing, but also be transmitted to the space surrounding the hollow housing by way of a plurality of directional grooves arranged around the hollow housing and reach where it cannot if exiting only through the front opening.

BACKGROUND OF THE INVENTION

With the rapid development of industrial technologies, multimedia products have been improved on a regular basis to provide more satisfaction to their users both visually and aurally. In order to make the most of acoustic resonance and generate the desired acoustic field, it is common practice to dispose a low-frequency loudspeaker and/or a high-frequency loudspeaker in an enclosure, whose internal cavity functions as a resonant cavity.

Please refer to FIG. 1 for a conventional loudspeaker enclosure structure 10 which essentially includes a hollow housing 11 and a cover 12. The front side of the hollow housing 11 is provided with an opening 110. Two opposite side walls 111 of the hollow housing 11 extend linearly backward in a converging manner from the periphery of the opening 110 to a rear wall 112 of the hollow housing 11. The other two opposite side walls 113 of the hollow housing 11 extend backward parallel to each other from the periphery of the opening 110 to the rear wall 112. An installation bracket 16 is pivotally connected to the side walls 113 so that the hollow housing 11 can be fixed at a proper location. An audio control circuit 13 is mounted in the hollow housing 11, or more specifically on the inner side of the rear wall 112, and is configured for receiving audio signals from an audio power amplifier (not shown) and performing audio processing on the signals. The cover 12 is sized to be fixed to the periphery of the opening 110 and is provided with a low-frequency loudspeaker 120, a high-frequency loudspeaker 121, and at least one bass reflex port 122. The high- and low-frequency audio signals generated by the audio control circuit 13 are respectively transmitted to the high-frequency loudspeaker 121 and the low-frequency loudspeaker 120, causing the membranes thereof to vibrate and make high- and low-frequency sounds respectively. Typically, a sound absorbing material 14 made of non-woven fabrics or foam is placed between the cover 12 and the audio control circuit 13 of the loudspeaker enclosure structure 10 to absorb low-frequency vibrations, thereby preventing the signal wires and power wires on the audio control circuit 13 from low-frequency resonance, which, if present, will interfere with low-frequency output from the loudspeaker enclosure structure 10. In addition, a dust shield 15 having a web-like structure is provided on the outer side of the cover 12 to protect the loudspeakers 120, 121 and keep dust and other foreign matter from entering the loudspeaker enclosure structure 10.

As stated above, the two opposite side walls 111 of the hollow housing 11 of the conventional loudspeaker enclosure structure 10 extend linearly backward in a converging manner from the periphery of the opening 110 to the rear wall 112, and this configuration is intended mainly to enhance low-frequency resonance of the loudspeaker enclosure structure 10. More particularly, when transient vibration of the membrane of the low-frequency loudspeaker 120 generates a backward pushing force to the air in the hollow housing 11 (i.e., when the membrane of the low-frequency loudspeaker 120 is displaced backward), the air in the hollow housing 11 flows backward along the backwardly extending and linearly converging side walls 111, making the loudspeaker enclosure resonate at a low frequency. However, once the air flowing backward along the backwardly extending and linearly converging side walls 111 hits the rear wall 112, the air in the hollow housing 11 will bounce back toward the opening 110 due to the compressibility of air. Consequently, vibration of the membrane of the low-frequency loudspeaker 120 is adversely affected. To solve this problem, the cover 12 is formed with the bass reflex port 122, through which the rebounding air is allowed to exit.

Referring back to FIG. 1, while the bass reflex port 122 on the cover 12 can effectively prevent the rebounding air in the hollow housing 11 from compromising vibration of the membrane of the low-frequency loudspeaker 120, the fact that the rebounding air in the hollow housing 11 can exit only by way of the opening 110 on the front side of the hollow housing 11 has its drawbacks. More specifically, some of the rebounding air will cause unnecessary vibration of the cover 12 while the remainder of the rebounding air exits through the bass reflex port 122. Such unnecessary vibration is detrimental to vibration of the membrane of the low-frequency loudspeaker 120 and will result in distortion of the bass notes. Moreover, as all the sound waves in the conventional loudspeaker enclosure structure 10 propagate outward through the opening 110 on the front side of the hollow housing 11, the reflected waves and those which propagate directly out of the opening 110 without being reflected will interfere with each other, causing beats and hence frequency cancellation, if not severe degradation of output sound quality, thus hindering further improvement on the sound quality of the loudspeaker enclosure structure 10. In addition, now that all the sound waves exit through the opening 110 on the front side of the hollow housing 11, the spatial range of sound propagation is substantially limited. In other words, the conventional loudspeaker enclosure structure 10 is incapable of generating a wide acoustic field.

It can be known from the above that the conventional loudspeaker enclosure structures are still flawed in design and fail to provide satisfactory sound effects. Therefore, the issue to be addressed by the present invention is to design a loudspeaker enclosure structure which not only can prevent the air rebounding in its hollow housing from impacting vibration of the membrane of a low-frequency loudspeaker, but also can prevent sound wave cancellation which may otherwise occur if all the sound waves propagate outward through the same opening on the front side of the hollow housing and which, if occurring, will impair sound quality. It is also desirable that the loudspeaker enclosure structure enables multidirectional transmission of sound and hence a wider range of sound propagation than the prior art (i.e., allowing the sound to reach where it cannot if exiting only through the opening on the front side of the hollow housing). In a nutshell, the loudspeaker enclosure structure is expected to precisely provide the desired frequency range or acoustic field.

BRIEF SUMMARY OF THE INVENTION

In view of, and in order to overcome, the foregoing drawbacks of the conventional loudspeaker enclosure structures, the inventor of the present invention conducted extensive research and numerous tests by applying years of practical experience in the related field into practice. Finally, a barrel-shaped multidirectional loudspeaker enclosure structure was successfully developed as a solution to the aforementioned problems of the prior art.

It is an object of the present invention to provide a barrel-shaped multidirectional loudspeaker enclosure structure which essentially includes a hollow housing, a loudspeaker, and a reflective cover. The hollow housing is a barrel-shaped housing whose outer surface is concavely provided with a plurality of directional grooves. The directional grooves are evenly arranged along the circumferential direction of the hollow housing and each extend from the front end to the rear end of the hollow housing. The loudspeaker is fixed in the hollow housing so that the sound generated by the loudspeaker can propagate out of the front end of the hollow housing through a front opening of the hollow housing. The reflective cover has a front side fixed to a rear opening of the hollow housing. Moreover, the front side of the reflective cover is concavely provided with an annular reflective groove adjacent to the periphery of the reflective cover. The hollow housing has a receiving space therein which is in communication with each directional groove through the reflective groove. Therefore, the sound generated in the receiving space by the loudspeaker will be transmitted in a directional manner to the space surrounding the hollow housing by way of the directional grooves arranged around the barrel-shaped housing body. In particular, the sound thus transmitted will reach where it cannot if exiting only through the front opening.

Another object of the present invention is to provide the foregoing loudspeaker enclosure structure, wherein the loudspeaker enclosure structure further includes an amplifying horn. The amplifying horn is a hollow tube having an amplification opening and an installation opening at its front and rear ends respectively, wherein the amplification opening has a greater inner diameter than the installation opening. Also, an amplification duct is formed in the amplifying horn and communicates with the amplification opening and the installation opening. The amplifying horn is installed on the hollow housing in such a way that the front end of the amplifying horn is fixed at the front opening of the hollow housing while both the installation opening and the amplification duct extend into the receiving space. The installation opening is provided so that the loudspeaker can be fixed thereat, thus allowing the sound generated by the loudspeaker to pass sequentially through the amplification duct and the amplification opening before coming out of the front end of the hollow housing.

Still another object of the present invention is to provide the foregoing loudspeaker enclosure structure, wherein the reflective cover is fixed at the rear opening of the hollow housing in a position-adjustable manner. More specifically, the gap between the reflective cover and the rear end of the hollow housing can be adjusted so that the sound generated in the receiving space by the loudspeaker can be reflected at different angles and propagate out of the hollow housing (to an area inaccessible to the sound if the sound exits only through the front opening) via different spaces while passing sequentially through the reflective groove and the directional grooves.

Yet another object of the present invention is to provide the foregoing loudspeaker enclosure structure, wherein the outer surface of the hollow housing is concavely provided with at least one positioning groove which is adjacent to the middle section of the hollow housing and which extends along the circumferential direction of the hollow housing. Thus, a plurality of like multidirectional loudspeaker enclosure structures can be connected together and fixed to an external object (e.g., the ceiling of an opera house or the supporting frames on an open-air concert stage) by at least one connecting element working in conjunction with the at least one positioning groove of each loudspeaker enclosure structure.

A further object of the present invention is to provide the foregoing loudspeaker enclosure structure, wherein the amplifying horn is provided therein with at least one connecting frame corresponding in position to the amplification duct. The at least one connecting frame is provided so that a second loudspeaker can be mounted thereon. The second loudspeaker has a smaller diameter and generates a higher-frequency sound than the aforesaid loudspeaker.

Still another object of the present invention is to provide the foregoing loudspeaker enclosure structure, wherein the at least one connecting frame is mounted with a compression/deflection cover. The distance between the compression/deflection cover and the inner wall of the amplifying horn is less at the end of the compression/deflection cover that is adjacent to the amplification opening (i.e., the end farther from the loudspeaker) than at the end of the compression/deflection cover that is adjacent to the installation opening (i.e., the end closer to the loudspeaker). This ensures that the sound waves generated by the loudspeaker will be compressed by the compression/deflection cover and the inner wall of the amplifying horn and therefore transmitted to a greater distance than without the compression/deflection cover.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
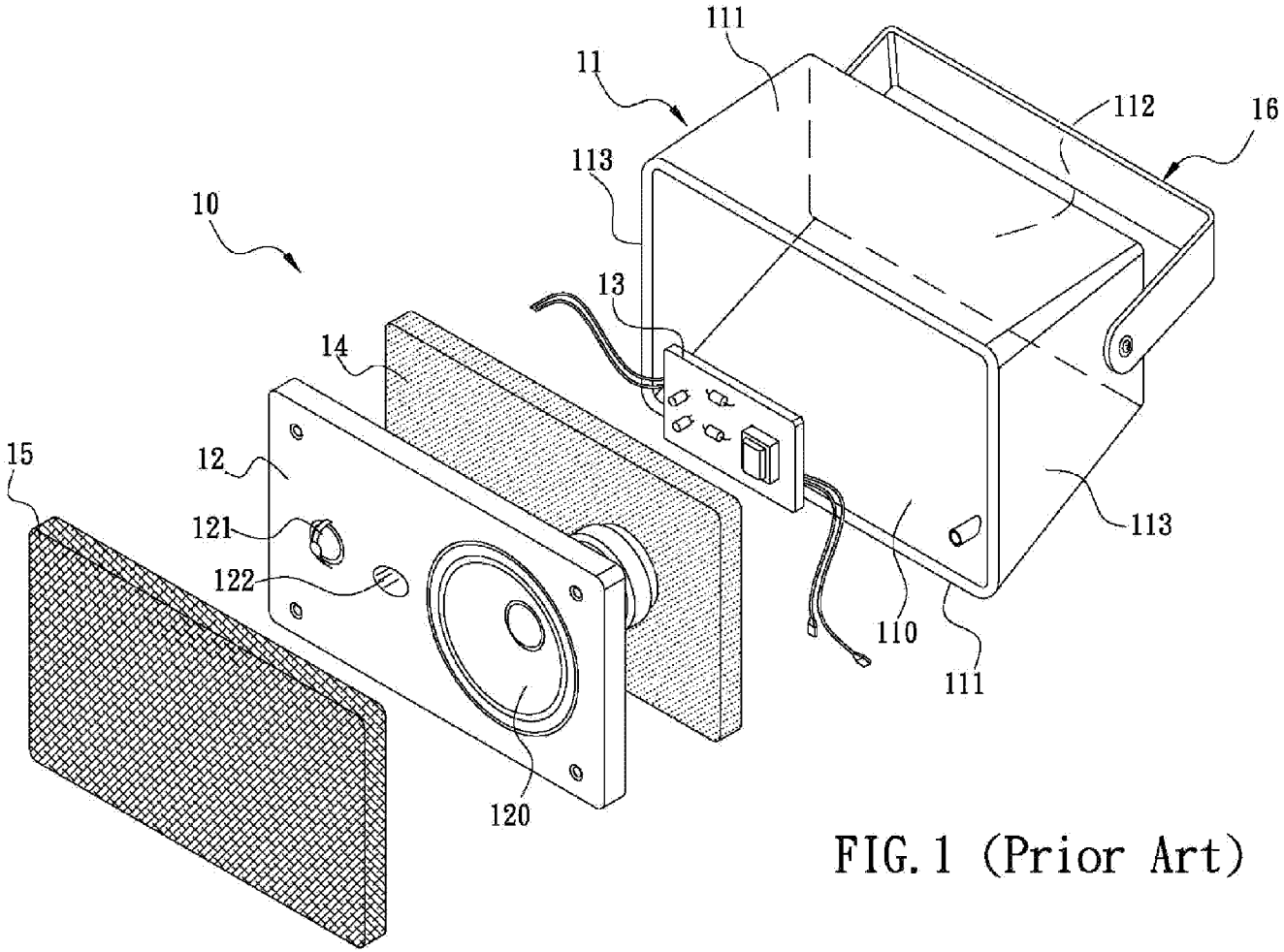
FIG. 1 (Prior Art)
FIG. 1 is an exploded perspective view of a conventional loudspeaker enclosure structure.
Figure 2:
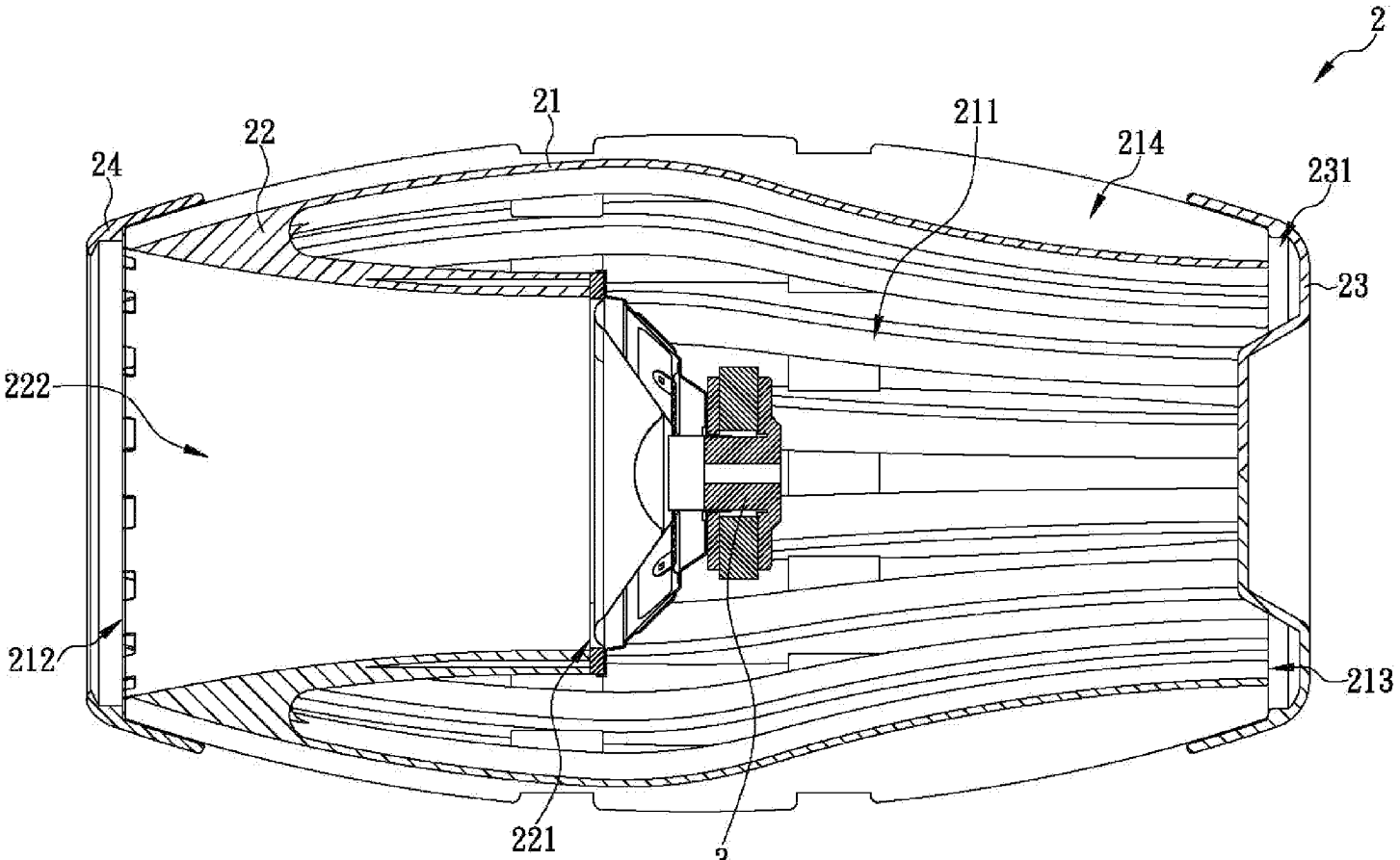
FIG. 2 is a sectional view of the loudspeaker enclosure structure according to the first preferred embodiment of the present invention.
Figure 3:
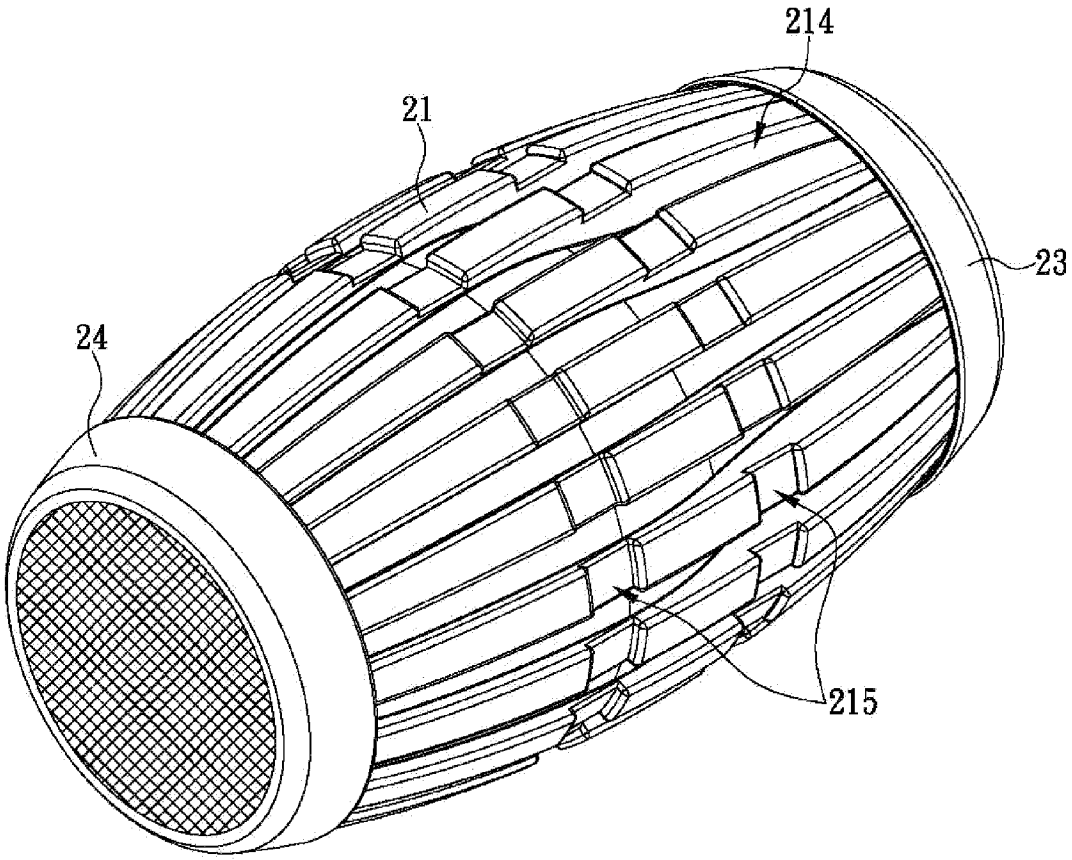
FIG. 3 is a perspective view of the loudspeaker enclosure structure according to the first preferred embodiment of the present invention.

The present invention discloses a barrel-shaped multidirectional loudspeaker enclosure structure. Referring to FIG. 2 for the first preferred embodiment of the present invention, the loudspeaker enclosure structure 2 essentially includes a hollow housing 21, an amplifying horn 22, a loudspeaker 3, and a reflective cover 23. The hollow housing 21 is a barrel-shaped housing having a receiving space 211 therein. The front and rear ends of the hollow housing 21 are formed with a front opening 212 and a rear opening 213 respectively, wherein the front opening 212 and the rear opening 213 are in communication with the receiving space 211. In the first preferred embodiment, the hollow housing 21 resembles a barrel in shape, but the present invention imposes no limitations on the overall contour of the hollow housing 21. In practice, the hollow housing 21 may alternatively have a generally triangular or rectangular cross-section, and the curvature of the contour of the housing may be adjusted as needed. The hollow housing 21 has a greater outer diameter in the middle section than at the front opening 212 and the rear opening 213. As shown in FIG. 2 and FIG. 3, the outer surface of the hollow housing 21 is concavely provided with a plurality of directional grooves 214. The directional grooves 214 are arranged at even intervals along the circumferential direction of the hollow housing 21 and each extend from the front end to the rear end of the hollow housing 21. The average depth of the directional grooves 214 is greater in a part of the directional grooves 214 that lies between their middle section and the rear opening 213 than in a part of the directional grooves 214 that lies between their middle section and the front opening 212; however, the present invention is not limited to this configuration. The depths of the directional grooves 214 may be redesigned according to the desired acoustic effects.

The amplifying horn 22 is a hollow tube and has an amplification opening and an installation opening 221 at its front and rear ends respectively, wherein the inner diameter of the amplification opening is greater than that of the installation opening 221. An amplification duct 222 is formed in the amplifying horn 22 and is in communication with the amplification opening and the installation opening 221. The loudspeaker 3 is fixed at the installation opening 221 so that the sound generated by the loudspeaker 3 can pass sequentially through the amplification duct 222 and the amplification opening before exiting the front end of the hollow housing 21. To protect the loudspeaker 3 from dust and other foreign matter, the front end of the hollow housing 21 in this embodiment is further provided with a front cover plate 24 (e.g., a screen) which corresponds in position to the front opening 212. The front cover plate 24 serves to block entry of dust and other foreign matter into the hollow housing 21. In the first preferred embodiment, the amplifying horn 22 is integrally formed with the hollow housing 21; hence, the amplification opening of the amplifying horn 22 is the front opening 212 of the hollow housing 21. Nevertheless, the loudspeaker enclosure structure 2 of the present invention is by no means limited to this configuration. For example, the amplifying horn 22 and the hollow housing 21 may be designed as two or even more separate elements, provided that, once the amplifying horn 22 is installed on the hollow housing 21, the front end of the amplifying horn 22 is fixed at the front opening 212 of the hollow housing 21, with the installation opening 221 and the amplification duct 222 of the amplifying horn 22 extending into the receiving space 211.

Figure 4:
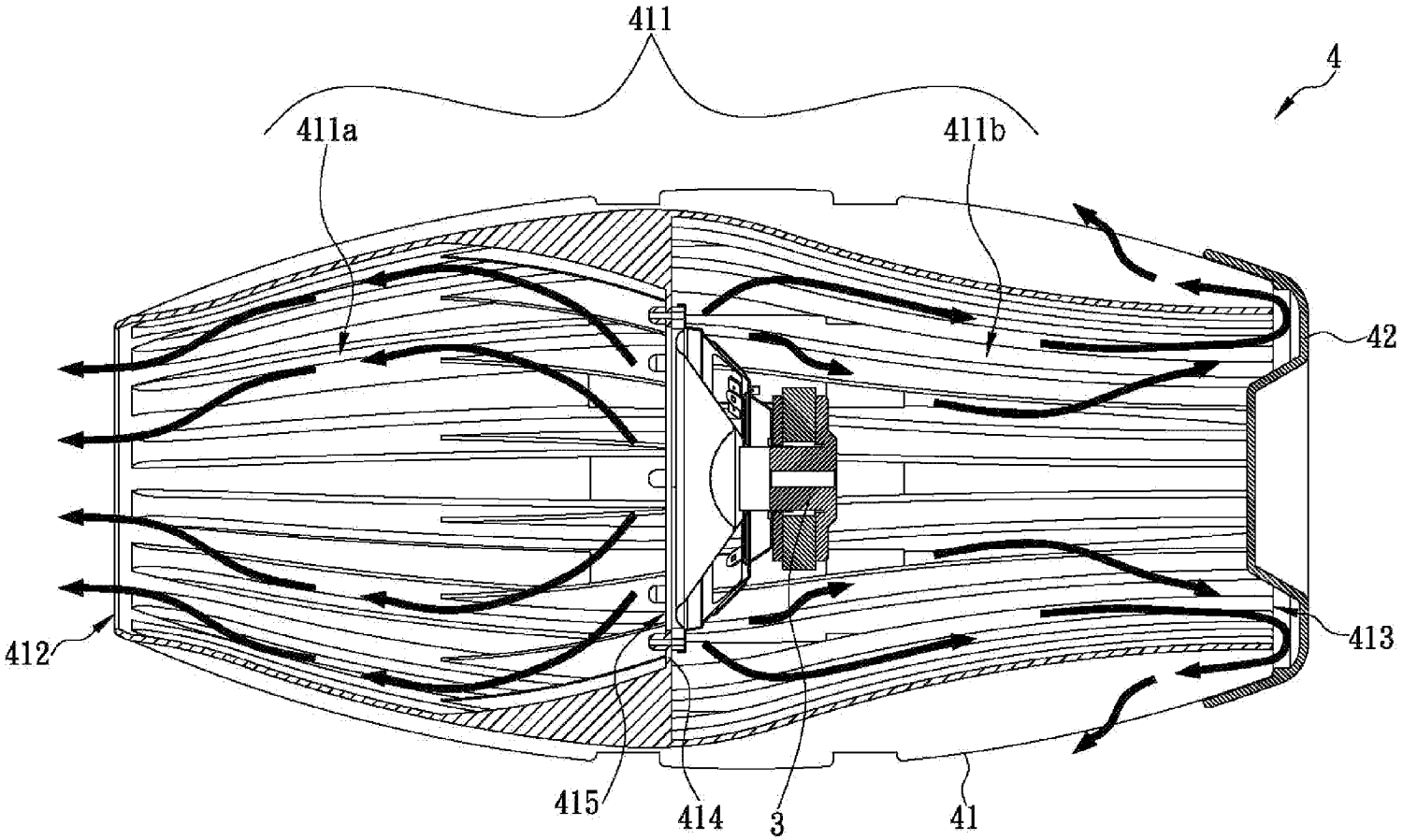
FIG. 4 is a sectional view of the loudspeaker enclosure structure according to the second preferred embodiment of the present invention.
Figure 5:
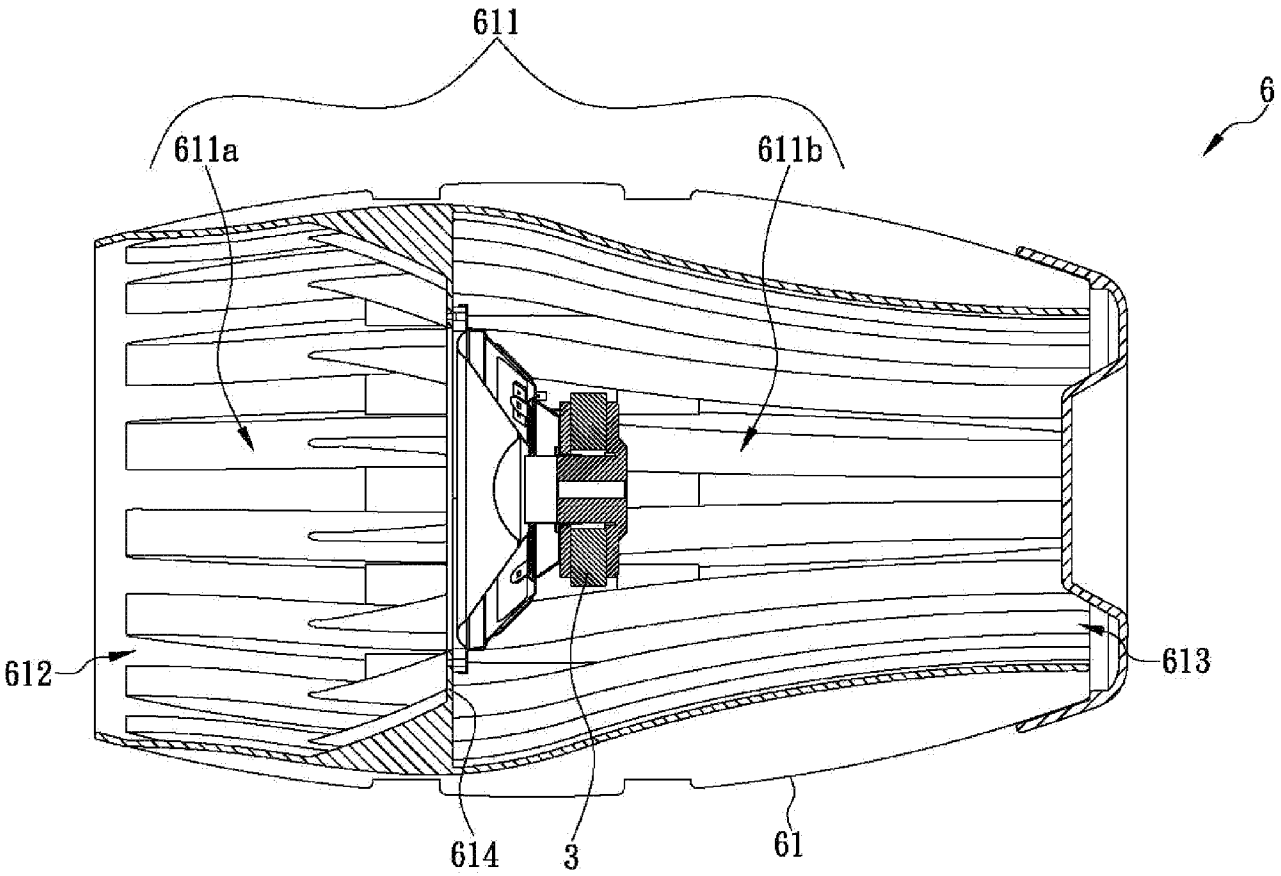
FIG. 5 is a sectional view of the loudspeaker enclosure structure according to the third preferred embodiment of the present invention.

Referring to FIG. 4 for the second preferred embodiment of the present invention, the loudspeaker enclosure structure 4 essentially includes a hollow housing 41, a loudspeaker 3, and a reflective cover 42. The hollow housing 41 forms a receiving space 411 therein and has a front end and a rear end respectively formed with a front opening 412 and a rear opening 413. The reflective cover 42 covers the rear opening 413. In the second preferred embodiment, the hollow housing 41 is provided with an installation frame 414 which is adjacent to the middle section of the hollow housing 41 and which extends into the receiving space 411. The installation frame 414 divides the receiving space 411 into a front receiving space 411*a* and a rear receiving space 411*b*. The installation frame 414 is formed with an installation opening 415, and the loudspeaker 3 is fixed to the installation frame 414 at a position corresponding to the installation opening 415. Thus, the sound generated by the loudspeaker 3 can propagate out of the hollow housing 41 through the front end thereof by way of the front receiving space 411*a* and the front opening 412. It should be pointed out that, in order to provide high sound quality, the wall of the hollow housing 41 may be formed with a plurality of through holes (not shown) that correspond in position to the front receiving space 411*a*. This demonstrates that the amplifying horn 22 shown in FIG. 2 is not an essential element in the present invention and may be dispensed with. It should be noted, however, that while the loudspeaker enclosure structure 4 in the second preferred embodiment of the present invention does not have an amplifying horn 22, the amplifying horn 22 is nevertheless applicable to the hollow housing 41 in this embodiment. In practice, the hollow housing 41 and the amplifying horn 22 may be used in combination and be freely modified in design as appropriate. Besides, the ratio between the front opening 412 and the rear opening 413 may be adjusted according to practical needs, or the length ratio between the front receiving space 411*a* and the rear receiving space 411*b* may be adjusted by adjusting the position of the installation frame 414 along the front-rear direction of the hollow housing 41. For example, referring to FIG. 5 for the third preferred embodiment of the present invention, the loudspeaker enclosure structure 6 has a hollow housing 61 in which a receiving space 611 is formed. The hollow housing 61 is provided with an installation frame 614 which is adjacent to a front section of the hollow housing 61 and which extends into the receiving space 611 so that a loudspeaker 3 can be fixed to the installation frame 614. The installation frame 614 divides the receiving space 611 into a front receiving space 611*a* and a rear receiving space 611*b*. In the third preferred embodiment, the rear receiving space 611*b* is longer than the front receiving space 611*a* along the front-rear direction of the hollow housing 61, and the loudspeaker enclosure structure 6 has a front opening 612 greater in diameter than a rear opening 613 of the loudspeaker enclosure structure 6. In practice, the shape of the hollow housing 61 may be adjusted as appropriate. For example, the portion of the hollow housing 61 that corresponds in position to the front receiving space 611*a* or to the rear receiving space 611*b* may have a cross-section whose outer contour has different curvatures or consists of straight lines extending at different angles.

Referring back to FIG. 2 and FIG. 3, the loudspeaker 3 is fixed at the installation opening 221 of the amplifying horn 22 so that the sound generated by the loudspeaker 3 can propagate out of the front end of the hollow housing 21 through the amplification duct 222 and the amplification opening, in that order.

The reflective cover 23 is a disc-shaped element whose front side is concavely provided with an annular reflective groove 231 adjacent to the periphery of the disc-shaped element. The front side of the disc-shaped element is fixed at the rear opening 213 of the hollow housing 21 such that the receiving space 211 is in communication with each directional groove 214 through the reflective groove 231. Hence, the sound generated in the receiving space 211 by the loudspeaker 3 will be reflected by the reflective groove 231 and transmitted in a directional manner (i.e., through the directional grooves 214) to a space surrounding the hollow housing 21 but not in front of the hollow housing 21. The sound generated by the loudspeaker 3 can thus reach a space inaccessible to the sound if the front opening 212 were the only exit. It should be pointed out that the hollow housing 21 or the reflective cover 23 may be modified in design according to practical needs so that the reflective cover 23 is position-adjustably fixed at the rear opening 213 of the hollow housing 21. For instance, an adjustment mechanism (not shown) is provided in the hollow housing 21 to enable adjustment of the gap between the reflective cover 23 and the rear end of the hollow housing 21. This allows the sound generated in the receiving space 211 by the loudspeaker 3 to be reflected at different angles and be transmitted through different spaces while propagating out of the hollow housing 21 (i.e., to a space inaccessible to the sound if the sound exits only through the front opening 212) via the reflective groove 231 and then the directional grooves 214 formed on, and arranged along the circumferential direction of, the barrel-shaped housing body.

According to the above description, the multidirectional loudspeaker enclosure structure 2 of the present invention is so designed that not only can the sound generated from the front end of the loudspeaker 3 be directly and precisely projected to the front end of the hollow housing 21 through the amplification duct 222 and the amplification opening, but also the sound generated in the receiving space 211 from the rear end of the loudspeaker 3 can be precisely transmitted in an indirect and directional manner (i.e., through reflection of the reflective groove 231 and the directional design of the directional grooves 214) to a space that cannot be reached by the sound output from the amplification opening. In other words, the structural design of the present invention enables both the front and rear ends of the hollow housing 21 to reflect, compress, concentrate, and release the sound generated by the loudspeaker 3, thereby effectively increasing the distance of sound propagation and the power of thump and punch, so as for the loudspeaker enclosure structure 2 of the present invention to precisely provide the desired frequency range or acoustic field.

Figure 6:
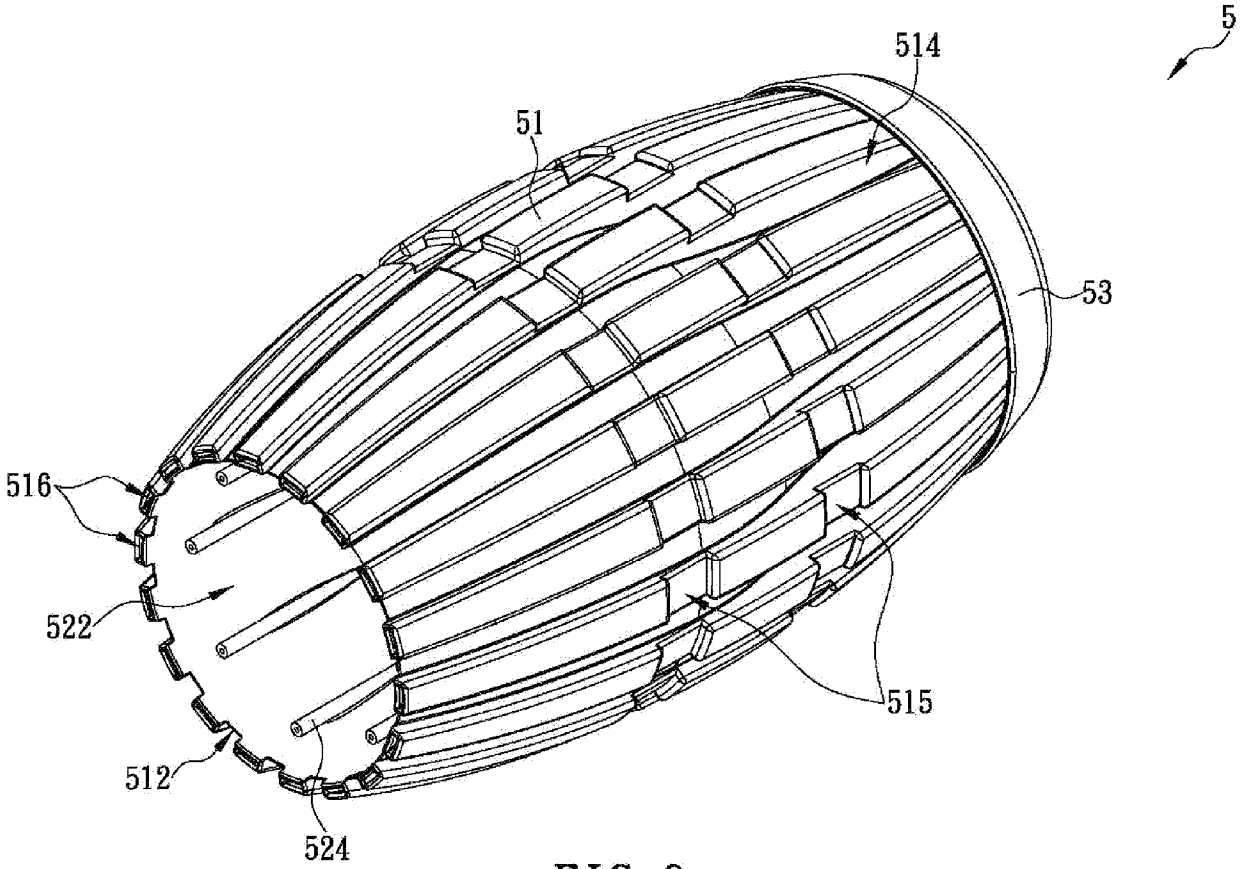
FIG. 6 is a perspective view of the loudspeaker enclosure structure according to the fourth preferred embodiment of the present invention.
Figure 7:
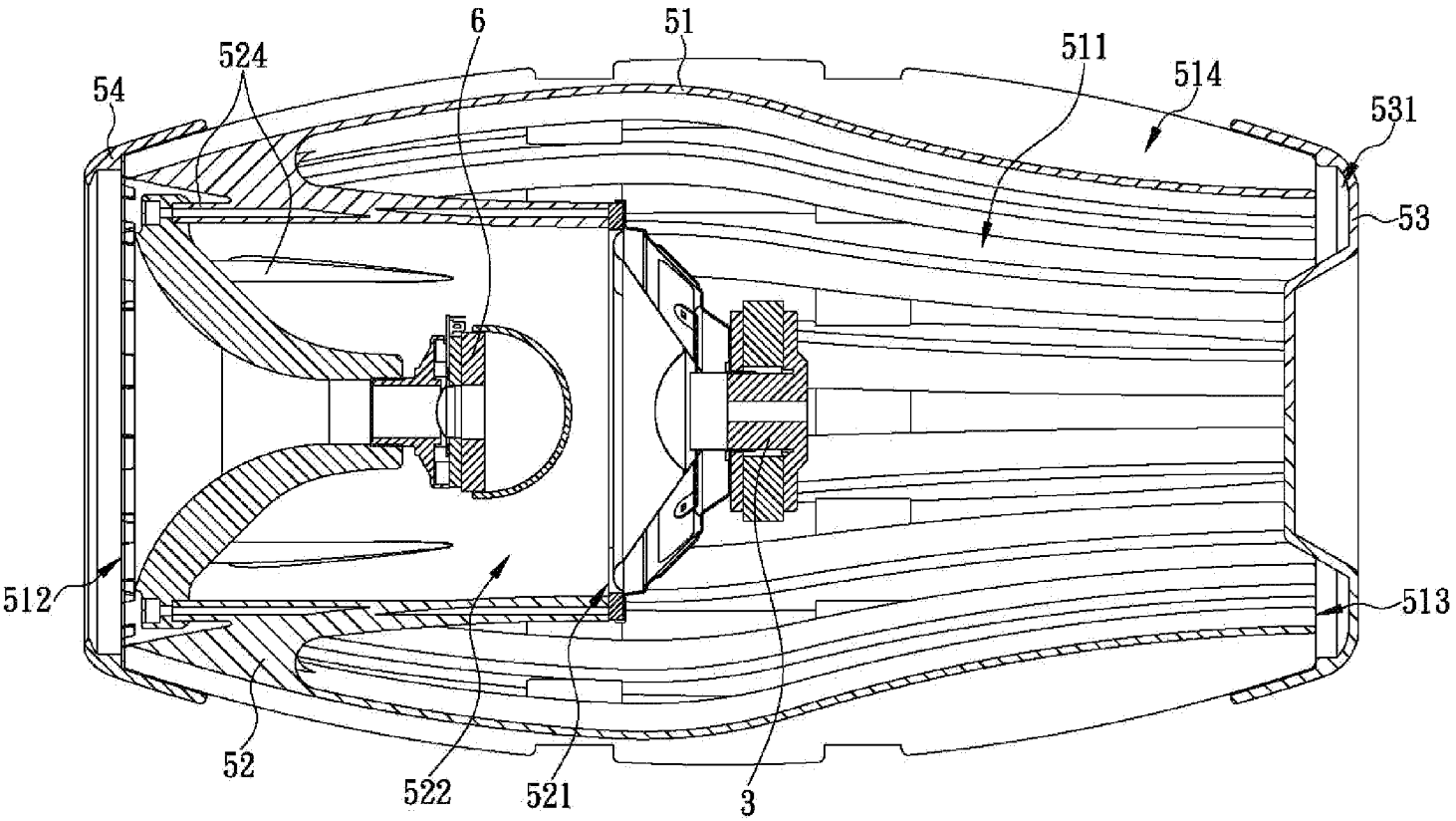
FIG. 7 is a sectional view of the loudspeaker enclosure structure according to the fourth preferred embodiment of the present invention.
Figure 8:
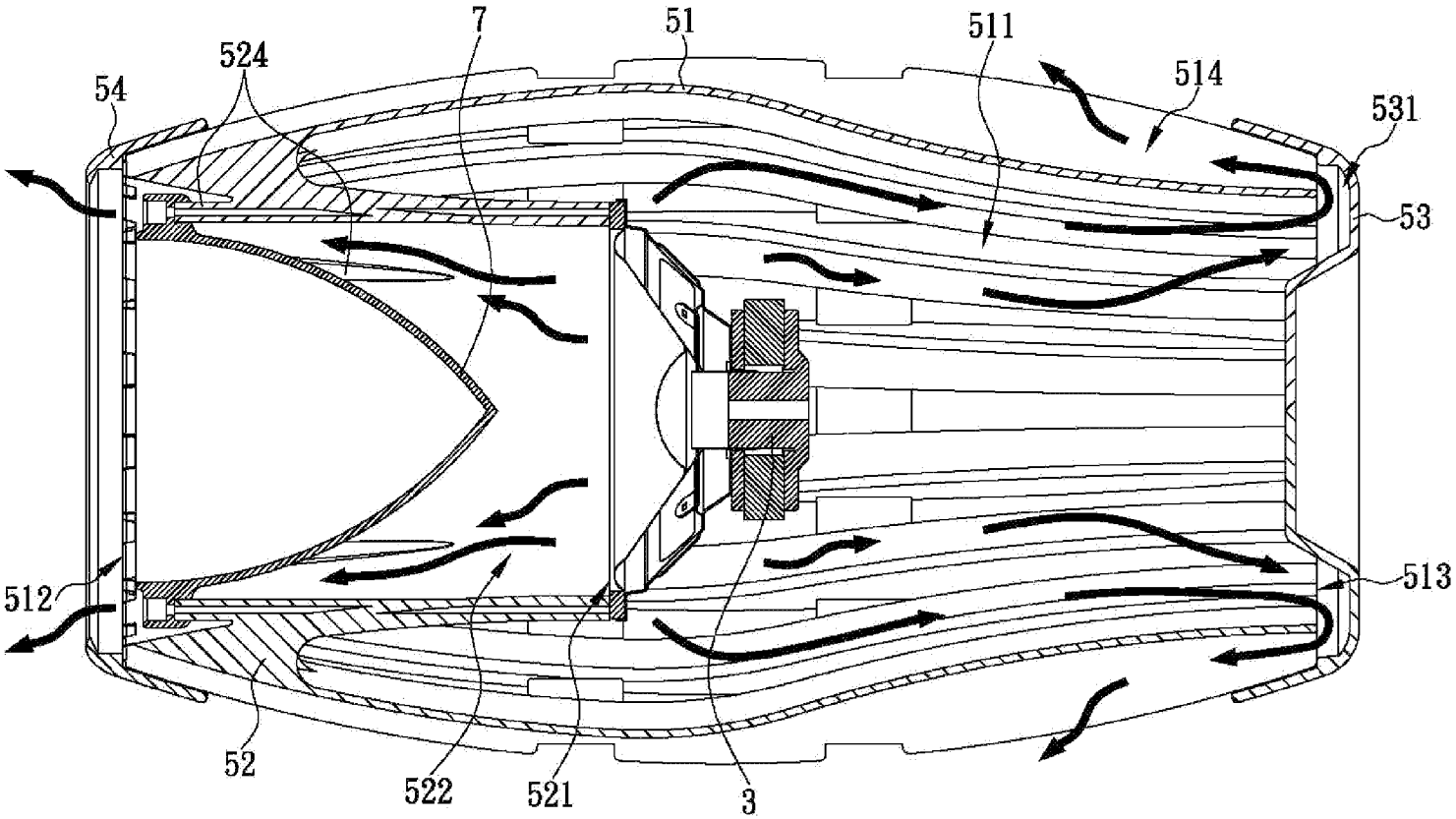
FIG. 8 is a sectional view of the loudspeaker enclosure structure according to the fifth preferred embodiment of the present invention.
Figure 9:
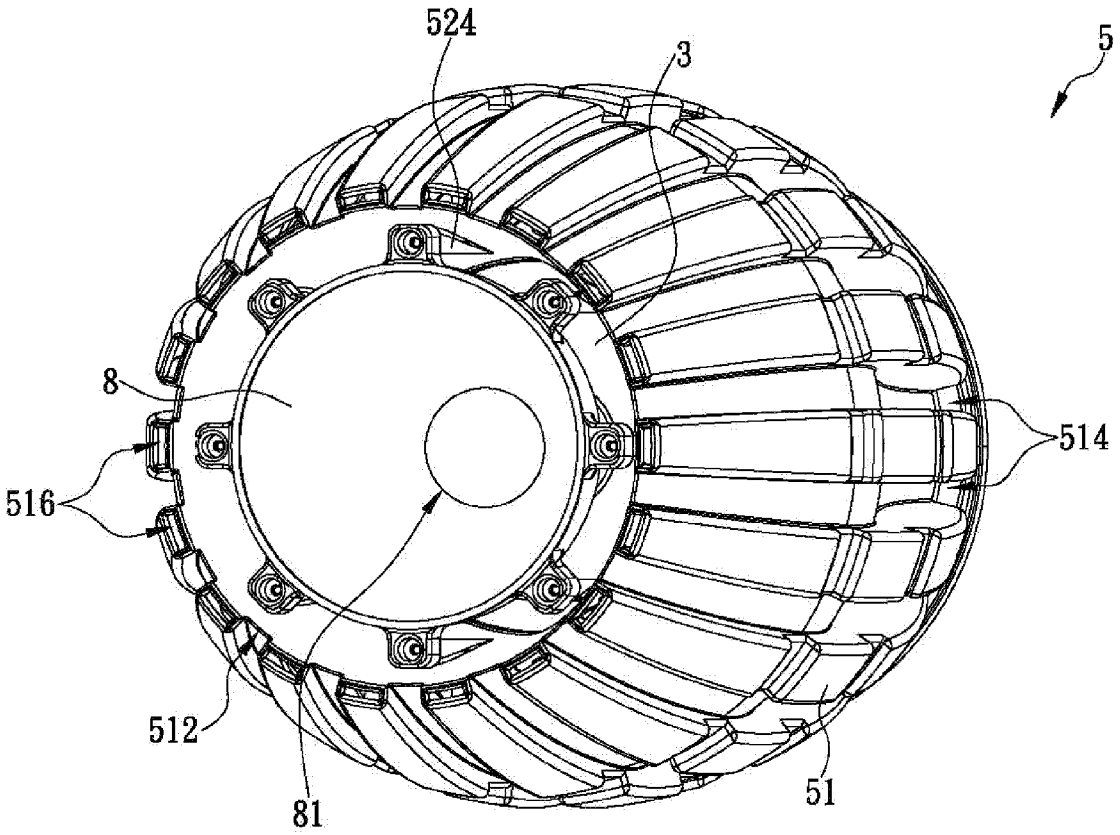
FIG. 9 is a perspective view of the loudspeaker enclosure structure according to the sixth preferred embodiment of the present invention.

In the fourth preferred embodiment of the present invention as shown in FIG. 6 and FIG. 7, the amplifying horn 52 of the loudspeaker enclosure structure 5 is further provided with at least one connecting frame 524 which corresponds in position to the amplification duct 522. The connecting frames 524 are configured for the installation of a second loudspeaker 6 whose diameter is smaller than that of the loudspeaker 3 and whose frequency is higher than that of the loudspeaker 3. Once both loudspeakers 3 and 6 are installed, the sound generated by the former as well as the sound generated by the latter can propagate out of the front end of the hollow housing 51 through the front opening 512 of the hollow housing 51. Continued from the above, and referring to FIG. 8 for the fifth preferred embodiment of the present invention, the connecting frames 524 are provided so that a compression/deflection cover 7 can be mounted thereon. The distance between the compression/deflection cover 7 and the inner wall of the amplifying horn 52 is less at the end of the compression/deflection cover 7 that is adjacent to the amplification opening of the amplifying horn 52 (i.e., the end farther from the loudspeaker 3) than at the end of the compression/deflection cover 7 that is adjacent to the installation opening 521 (i.e., the end closer to the loudspeaker 3). Thus, the sound waves generated by the loudspeaker 3 will be compressed by the compression/deflection cover 7 and the inner wall of the amplifying horn 52 and hence transmitted farther than if the compression/deflection cover 7 were absent. Besides, referring to FIG. 9 for the sixth preferred embodiment of the present invention, the connecting frames 524 may have an alternative compression/deflection cover 8 mounted thereon, wherein the alternative compression/deflection cover 8 has a through hole 81 at the tip (i.e., the end closer to the loudspeaker 3). Because of the through hole 81 of the alternative compression-deflection cover 8, some of the sound generated by the loudspeaker 3 will pass directly through the alternative compression/deflection cover 8 and propagate out of the front end of the hollow housing 51 via the front opening 512 of the hollow housing 51, thereby enhancing the mid-frequency output of the loudspeaker enclosure structure 5. In another embodiment of the present invention, a light-emitting diode (LED) or light bulb (not shown) is mounted at the through hole 81 so that the loudspeaker enclosure structure 5 of the present invention can be used in an overhead loudspeaker lighting system, as explained in more detail below.

In the fourth preferred embodiment of the present invention, referring back to FIG. 6 and FIG. 7, the front end of the hollow housing 51 is peripherally formed with a plurality of mounting holes 516 adjacent to the front opening 512 to enable installation of additional elements (not shown). For instance, a manufacturer of the loudspeaker enclosure structure 5 of the present invention may install an LED (not shown) in each of the mounting holes 516, so as for the LEDs and the loudspeaker 3 to work in concert and produce rich audio/visual effects. At the same time, the front cover plate 54 of the loudspeaker enclosure structure 5 may be modified in design to adapt to and make the most of the additional elements. For example, when the additional elements are LEDs, the front cover plate 54 may be made of a light-permeable material, thus allowing the light emitted by the additional elements to project forward of the hollow housing 51 through the front cover plate 54.

Figure 10:
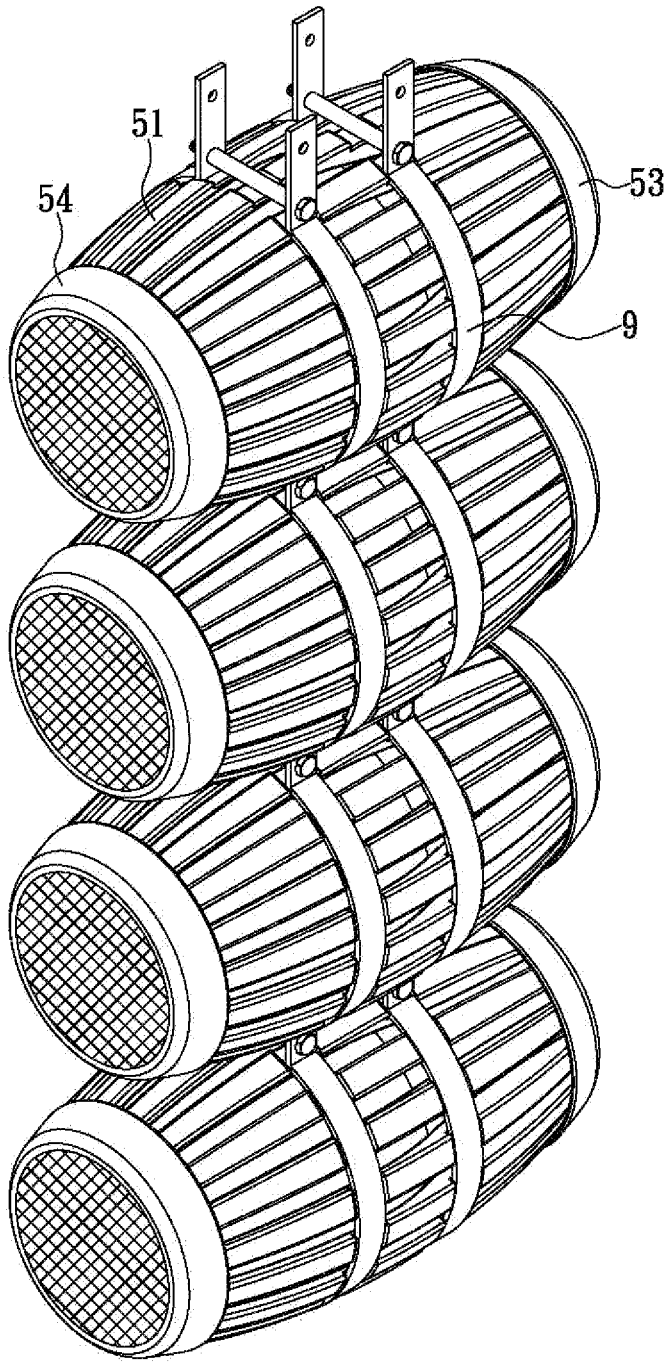
FIG. 10 is a perspective view of a plurality of loudspeaker enclosure structures of the present invention connected to one another in a vertical configuration.

Referring to FIG. 6 and FIG. 10, the outer surface of the hollow housing 51 is concavely provided with at least one positioning groove 515 which is adjacent to the middle section of the hollow housing 51 and which extends along the circumferential direction of the hollow housing 51. In the fourth preferred embodiment of the present invention, a plurality of loudspeaker enclosure structures 5 can be connected together and fixed to an object (e.g., the ceiling of an opera house or the stage truss of an open-air concert) by means of two corresponding connecting elements 9. In practice, the structure of the connecting elements 9 may be modified so as for the loudspeaker enclosure structures 5 to be connected in different configurations. A user may freely connect a plurality of loudspeaker enclosure structures 5 together according to practical needs, with a view to precisely rendering the desired frequency range or acoustic field.

While the invention herein disclosed has been described by means of specific embodiments, numerous modifications and variations could be made thereto by those skilled in the art without departing from the scope of the invention set forth in the claims.

What is claimed is:

1. A barrel-shaped multidirectional loudspeaker enclosure structure, comprising:

a hollow housing of a barrel shape, the hollow housing forming a receiving space therein and having a front end and a rear end respectively formed with a front opening and a rear opening, both said openings being in communication with the receiving space, the hollow housing having a middle section whose outer diameter is greater than an outer diameter of the front opening and an outer diameter of the rear opening, the hollow housing having an outer surface concavely provided with a plurality of directional grooves, the directional grooves being evenly arranged along a circumferential direction of the hollow housing and each extending from the front end to the rear end of the hollow housing, wherein the directional grooves have a greater average depth in a part thereof that lies between a middle section of the directional grooves and the rear opening than in a part thereof that lies between the middle section of the directional grooves and the front opening;

a loudspeaker fixed in the hollow housing so that a sound generated by the loudspeaker can propagate out of the front end of the hollow housing through the front opening; and a reflective cover formed as a disc-shaped element, the disc-shaped element having a front side concavely provided with an annular reflective groove adjacent to a periphery of the disc-shaped element, the front side of the disc-shaped element being fixed to the rear opening of the hollow housing such that the receiving space is in communication with each said directional groove through the reflective groove, allowing a sound generated in the receiving space by the loudspeaker to be transmitted in a directional manner, by reflection of the reflective groove and via the directional grooves, to a space surrounding but not in front of the hollow housing.

2. The loudspeaker enclosure structure of claim 1, further comprising an amplifying horn, the amplifying horn being a hollow tube and having a front end and a rear end respectively formed with an amplification opening and an installation opening, the amplifying horn forming an amplification duct therein, the amplification opening and the installation opening being in communication with the amplification duct, the amplification opening having an inner diameter greater than an inner diameter of the installation opening, the amplifying horn being installed on the hollow housing in such a way that the front end of the amplifying horn is fixed at the front opening of the hollow housing while both the installation opening and the amplification duct extend into the receiving space, the loudspeaker being fixed at the installation opening so that a sound generated by the loudspeaker can propagate out of the front end of the hollow housing sequentially through the amplification duct and the amplification opening.

3. The loudspeaker enclosure structure of claim 2, wherein the reflective cover is position-adjustably fixed at the rear opening of the hollow housing so that, by adjusting a gap between the reflective cover and the rear end of the hollow housing, a sound generated in the receiving space by the loudspeaker can be reflected at different angles and be transmitted through difference spaces while propagating out of the hollow housing sequentially through the reflective groove and the directional grooves.

4. The loudspeaker enclosure structure of claim 3, wherein the outer surface of the hollow housing is concavely provided with at least one positioning groove which is adjacent to the middle section, and extends along the circumferential direction, of the hollow housing, so as for a plurality of said loudspeaker enclosure structures to be connected together and fixed to an external object via at least one connecting element.

5. The loudspeaker enclosure structure of claim 4, wherein the amplifying horn is provided therein with at least one connecting frame corresponding in position to the amplification duct.

6. The loudspeaker enclosure structure of claim 5, wherein the at least one connecting frame is mounted with a second loudspeaker, the second loudspeaker having a smaller diameter and a higher frequency than the loudspeaker.

7. The loudspeaker enclosure structure of claim 5, wherein the at least one connecting frame is mounted with a compression/deflection cover, and a distance between the compression/deflection cover and an inner wall of the amplifying horn is less at an end of compression/deflection cover that is adjacent to the amplification opening than at an end of the compression/deflection cover that is adjacent to the installation opening.

8. The loudspeaker enclosure structure of claim 7, wherein the compression/deflection cover has a tip formed with a through hole.

9. The loudspeaker enclosure structure of claim 6, wherein the front end of the hollow housing is peripherally provided with at least one mounting hole adjacent to the front opening so that an additional element can be mounted at each said mounting hole.

10. The loudspeaker enclosure structure of claim 7, wherein the front end of the hollow housing is peripherally provided with at least one mounting hole adjacent to the front opening so that an additional element can be mounted at each said mounting hole.

11. The loudspeaker enclosure structure of claim 8, wherein the front end of the hollow housing is peripherally provided with at least one mounting hole adjacent to the front opening so that an additional element can be mounted at each said mounting hole.

12. The loudspeaker enclosure structure of claim 9, wherein a portion of the hollow housing that is adjacent to the front end thereof is formed with at least one through hole which opens to both an inside and an outside of the hollow housing.

13. The loudspeaker enclosure structure of claim 10, wherein a portion of the hollow housing that is adjacent to the front end thereof is formed with at least one through hole which opens to both an inside and an outside of the hollow housing.

14. The loudspeaker enclosure structure of claim 11, wherein a portion of the hollow housing that is adjacent to the front end thereof is formed with at least one through hole which opens to both an inside and an outside of the hollow housing.

* * * * *